US007988327B1

(12) United States Patent
Knoble et al.

(10) Patent No.: US 7,988,327 B1
(45) Date of Patent: Aug. 2, 2011

(54) LED LUMINAIRE

(75) Inventors: David W. Knoble, Tupelo, MS (US); Khosrow Jamasbi, Belden, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 189 days.

(21) Appl. No.: 12/363,663

(22) Filed: Jan. 30, 2009

(51) Int. Cl.
*F21V 1/00* (2006.01)

(52) U.S. Cl. ..... 362/235; 362/227; 362/231; 362/244; 362/247; 362/249.02

(58) Field of Classification Search ..... 362/227, 362/231, 235, 237, 244, 247, 249.01–249.02, 362/294, 373, 561
See application file for complete search history.

(56) References Cited

U.S. PATENT DOCUMENTS

| | | | |
|---|---|---|---|
| 1,204,801 | A | 11/1916 | McArthur |
| 1,246,728 | A | 11/1917 | Downey |
| 1,247,000 | A | 11/1917 | Plaut |
| 1,701,176 | A | 2/1929 | Doane |
| 1,702,746 | A | 2/1929 | Prichard |
| 1,900,436 | A | 3/1933 | Dourgnon |
| 1,941,503 | A | 1/1934 | Villiers |
| 1,969,714 | A | 8/1934 | Burger |
| 2,198,077 | A | 4/1940 | Curtis |
| 3,055,535 | A | 9/1962 | Schneider |
| 3,413,462 | A | 11/1968 | Spero |
| 3,679,889 | A | 7/1972 | Franck |
| 3,748,465 | A | 7/1973 | Murray |
| 3,790,774 | A | 2/1974 | Miller |
| 4,164,010 | A | 8/1979 | Finch |
| 4,188,657 | A | 2/1980 | Reibling |
| 4,229,782 | A | 10/1980 | Ruud |
| 4,242,725 | A | 12/1980 | Douma |
| 4,261,028 | A | 4/1981 | Adam |
| 4,261,030 | A | 4/1981 | Hernandez |
| 4,293,901 | A | 10/1981 | Hernandez |
| 4,310,876 | A | 1/1982 | Small |
| 4,360,863 | A | 11/1982 | Barnes |
| 4,390,934 | A | 6/1983 | Willing |
| 4,410,931 | A | 10/1983 | DeCandia |
| 4,451,875 | A | 5/1984 | Odle |
| 4,471,411 | A | 9/1984 | Graham |
| 4,516,196 | A | 5/1985 | Blake |
| 4,531,180 | A | 7/1985 | Hernandez |
| 4,559,587 | A | 12/1985 | Quiogue |
| 4,564,888 | A | 1/1986 | Lewin |
| 4,569,003 | A | 2/1986 | Elmer |
| 4,587,602 | A | 5/1986 | Dean |
| 4,731,714 | A | 3/1988 | Kelly |
| 4,851,970 | A | 7/1989 | Bronder |
| 4,858,091 | A | 8/1989 | Fouke |
| 4,862,333 | A | 8/1989 | Brasket |
| 4,881,156 | A | 11/1989 | Shemitz |
| 4,894,758 | A | 1/1990 | O'Toole |
| 4,937,718 | A | 6/1990 | Murray |

(Continued)

*Primary Examiner* — Stephen F Husar
*Assistant Examiner* — Meghan K Dunwiddie

(57) ABSTRACT

A LED luminaire comprises a heat sink disposed above an LED array and in thermal communication with the LED array, the LED array having at least one red LED and a plurality of cool white LEDs, the at least one red LED providing a warmer correlated color temperature for an output light and the plurality of white LEDs providing a higher efficacy, a diffuser positioned to enclose the LED array between the heat sink and the diffuser, the diffuser color mixing the at least one red LED and the plurality of cool white LEDs rendering a red light from the at least one red LED indiscernible from a cool white light of the plurality of white LEDs, a reflector positioned adjacent the heat sink.

18 Claims, 6 Drawing Sheets

U.S. PATENT DOCUMENTS

| | | | | |
|---|---|---|---|---|
| 5,051,878 | A | 9/1991 | Ngai | |
| 5,158,348 | A | 10/1992 | Sakamoto | |
| 5,278,745 | A | 1/1994 | Kelly | |
| 5,289,358 | A | 2/1994 | Halemeier | |
| 5,307,254 | A | 4/1994 | Russello | |
| 5,313,379 | A | 5/1994 | Lemons | |
| 5,363,293 | A | 11/1994 | Lasker | |
| 5,379,199 | A | 1/1995 | Hirshenhorn | |
| 5,383,102 | A | 1/1995 | Jones | |
| D364,242 | S | 11/1995 | Fiorato | |
| 5,546,292 | A | 8/1996 | Shemitz | |
| 5,586,015 | A | 12/1996 | Baldwin | |
| 5,613,766 | A | 3/1997 | Raouf | |
| 5,615,947 | A | 4/1997 | Shambo | |
| 5,707,142 | A | 1/1998 | Gordin | |
| 5,938,317 | A | 8/1999 | Thornton | |
| 5,997,156 | A | 12/1999 | Perlo | |
| 5,997,158 | A | 12/1999 | Fischer | |
| 6,027,231 | A | 2/2000 | Fouke | |
| 6,059,422 | A | 5/2000 | Fischer | |
| 6,234,643 | B1 | 5/2001 | Lichon | |
| 6,238,065 | B1 | 5/2001 | Jones | |
| 6,260,981 | B1 | 7/2001 | Fiene | |
| 6,523,982 | B1 | 2/2003 | Haddad | |
| 6,703,799 | B2 | 3/2004 | Summerford | |
| 6,945,675 | B2 | 9/2005 | Jongewaard | |
| 6,948,829 | B2 | 9/2005 | Verdes | |
| 7,182,627 | B1 | 2/2007 | Huang | |
| 7,226,189 | B2 | 6/2007 | Lee | |
| 2005/0281034 | A1 | 12/2005 | Summerford | |
| 2006/0077657 | A1 | 4/2006 | Vickers | |
| 2006/0262544 | A1 | 11/2006 | Piepgras | |
| 2007/0070621 | A1 | 3/2007 | Rivas | |
| 2007/0236159 | A1 | 10/2007 | Beland | |
| 2007/0274084 | A1* | 11/2007 | Kan et al. | 362/373 |
| 2007/0274093 | A1* | 11/2007 | Haim et al. | 362/561 |
| 2008/0186731 | A1 | 8/2008 | Graham | |

* cited by examiner

LED LUMINAIRE

CROSS-REFERENCE TO RELATED DOCUMENTS

None

TECHNICAL FIELD

This invention pertains to a luminaire. More specifically the invention pertains to a luminaire having light emitting diodes (LEDs) wherein a plurality of cool white LEDs are utilized with at least one red LED to provide a warm light.

BACKGROUND

Light emitting diodes (LED) light sources are more efficient than most forms of widely used lamps, for example incandescent, high intensity discharge (HID) light sources or the like. One advantage of using LED sources is that the LEDs are more efficacious than incandescent light and more efficacious than some fluorescent and low wattage HID light sources. Another advantage to LED usage is that the LEDs may be configured as low voltage, low energy (UL Class 2) devices. This illuminates shock and fire hazards of high or line voltage connections. Another advantage of the LED light sources is that of the longer life when compared to other light forms. Typically LEDs will degrade only to 70% lumen output in 50,000 hours of operation with proper thermal management. Another advantage over fluorescent lighting is the ability of the LED light source to operate in cold weather, and, with proper thermal management, in hot environments. Yet, another advantage is the ability of the LED light source to dim over wide temperature ranges as well as the resistance to vibration, as compared to incandescent, HID or fluorescent light sources.

Along with these advantages, one perceived disadvantage of LED light sources is that the light LEDs, which are typically used for illumination, have a cool color. However, these LEDs are more efficient, providing higher lumen per watt, than warmer lights.

Given the foregoing deficiencies, it would be desirable to provide a high efficiency of cool light LED while also producing a warm color which is more desirable to a person utilizing the light from the LED source.

SUMMARY

A LED luminaire comprises a luminaire housing, a reflector being one of integral with or depending from the housing, a heat sink positioned adjacent the reflector, an LED array positioned adjacent and in thermal communication with the heat sink, the LED array having a plurality of cool white LEDs and at least one red LED to provide a warmer correlated color temperature at cooler operating temperature, a diffuser for mixing the cool white LED light and the at least one red LED light, the diffuser inhibiting independent viewing of the at least one red LED. The diffuser may have a jelly-jar shape. The diffuser may be formed of tempered glass. The diffuser may be a holographic diffuser. The LED array may comprise fewer red LEDs than white LEDs. The diffuser further comprises at least one lens for each of the LEDs of the LED array. The LED luminaire wherein the cool white LEDs have a correlated color temperature of from about 4,000 to about 10,000 Kelvin. The LED luminaire wherein the warmer correlated color temperature is from about 2,500 to about 3,900 Kelvin (K).

A LED luminaire comprises a heat sink disposed above an LED array and in thermal communication with the LED array, the LED array having at least one red LED and a plurality of cool white LEDs, the at least one red LED providing a warmer correlated color temperature for an output light and the plurality of white LEDs providing a higher efficacy, a diffuser positioned to enclose the LED array between the heat sink and the diffuser, the diffuser color mixing the at least one red LED and the plurality of cool white LEDs rendering a red light from the at least one red LED indiscernible from a cool white light of the plurality of white LEDs, a reflector positioned adjacent the heat sink. The diffuser may be formed of tempered glass and have a diffuse coating on one of an inner surface, an outer surface or both surfaces of the diffuser. The LED luminaire wherein the warmer output light has a correlated color temperature of between about 2,500 to about 3,900 Kelvin (K).

A LED luminaire comprises an upper housing, an LED array positioned within the upper housing, a heat sink in thermal communication with the LED array, the LED array having at least one red LED and a plurality of cool white LEDs, a diffuser disposed at least in part beneath the reflector, the diffuser mixing the light emitted from the LEDs rendering red light emitted from the at least one red LED discernable from white light emitted from the plurality of cool white lights. The LED luminaire further comprises a connecting plate disposed between the heat sink and the LED array. The LED luminaire further wherein the connecting plate has high heat transfer characteristics. The LED luminaire further comprises a reflector disposed adjacent the heat sink.

A LED luminaire comprises a circuit board, a plurality of cool white light emitting diodes and at least one red light emitting diode, each of the cool white light emitting diodes and the at least one red light emitting diode coupled to the circuit board, a translucent diffuser disposed about the circuit board, a reflector surrounding the translucent diffuser, wherein the circuit board comprises a greater number of cool white LEDs than red LEDs, and, wherein a light output is warmer than a cool white light and has a correlated color temperature of between about 2,500 to about 3,900 Kelvin (K). The LED luminaire wherein the circuit board comprises five of the cool white LEDs and one of the red light emitting diodes. The LED luminaire wherein the translucent diffuser is longitudinally extending and has a first end proximate the light emitting diodes and a second dome shaped end opposite the first.

BRIEF DESCRIPTION OF THE ILLUSTRATIONS

Embodiments of the invention are illustrated in the following illustrations.

DETAILED DESCRIPTION

Figure 1:
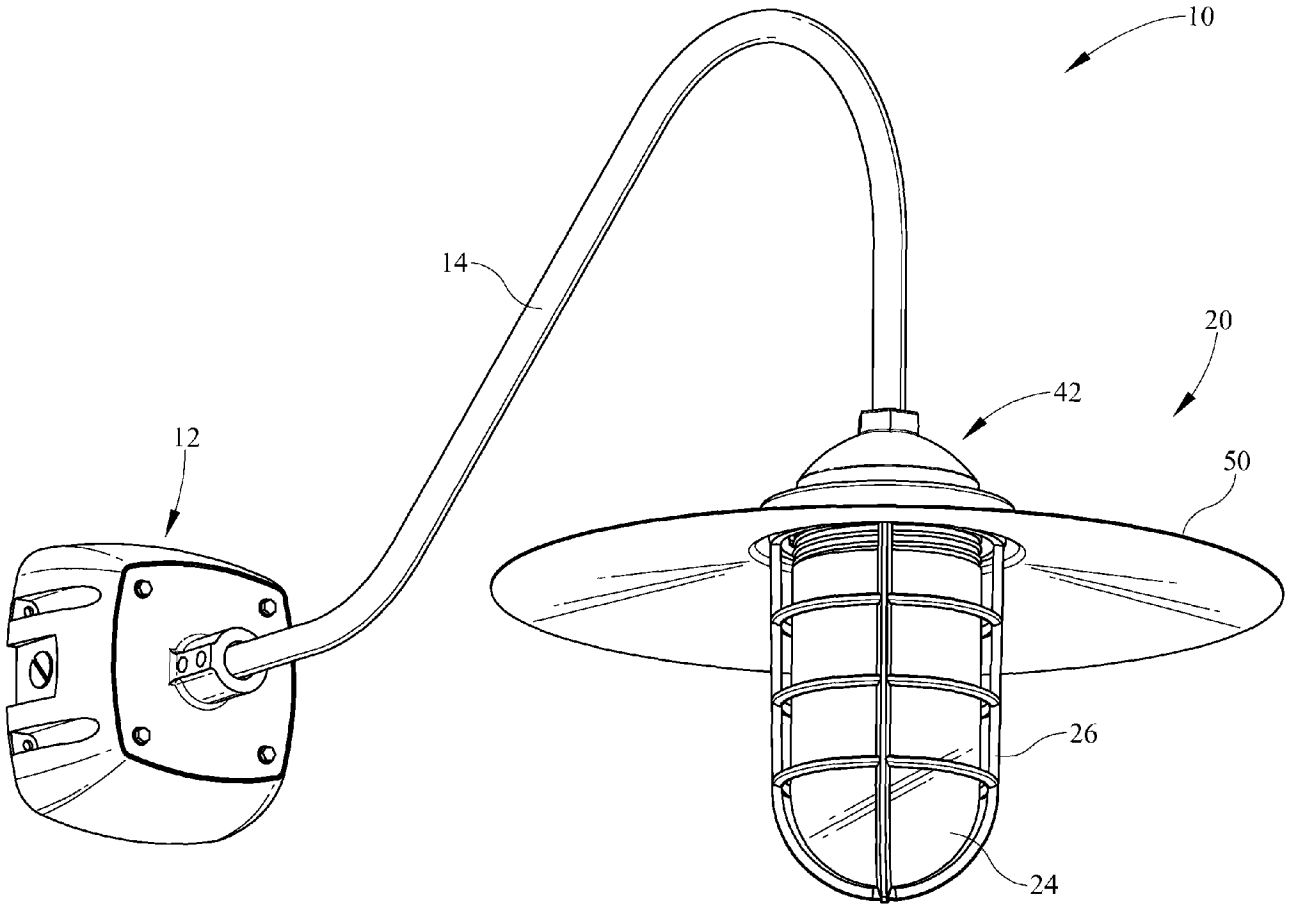
FIG. 1 is a perspective view of the LED luminaire of the present embodiment.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1-6 an LED luminaire. The luminaire structure is exemplary but comprises a lighting assembly which provides a plurality of cool white LEDs in combination with at least one red LED to provide a highly desirable warm light while maintaining the efficiency of white LED output.

Referring now in detail to the drawings, wherein like numerals indicate like elements throughout the several views, there are shown in FIG. 1 at least one embodiment of a light emitted diode (LED) luminaire 10. The luminaire 10 comprises a base 12 which is connected to a wall or other structure from which the luminaire 10 will extend or depend. The base has a frusto-pyramidal shape which may include four sides which are angled and may be curved as well as a surface along a common edge of the four sides. The surface comprises a collar wherein one end of a neck or stem 14 is received. The base 12 defines an enclosure wherein an LED driver 16 (FIG. 2) may be positioned. The base 12 is made of a cast metal material, such as aluminum, that may be formed of various structures and materials so as to be aesthetically pleasing while resistant to the elements in the area where the LED luminaire 10 is positioned.

Extending from the base 12 is the neck or stem portion 14 which is substantially tubular in cross section and hollow throughout defining a wireway. The neck 14 of the exemplary embodiment extends outwardly and is curved due to the base 12 being positioned on, for example, a vertical wall. Alternatively, the neck or stem 14 may be a straight tubular structure, for example if the base 12 is connected to a ceiling and the luminaire depends downwardly there from. The neck 14 extends from the base 12 so that wire from the LED driver 16 (FIG. 2) has a passageway to move to the lighting assembly 20. Additionally, the term tubular should not be considered limited to round tubing as various shapes may be utilized to carry the wire from the base 12 to the lighting assembly 20.

The neck 14 is a tubular structure which also functions as a conduit. Wiring extends from an LED driver (not shown) in the base 12 through the neck 14 to the lighting assembly 20 where the LEDs are positioned. The neck 14 may be formed of similar materials to the base 12 and the neck 14 and those materials may vary depending on the positioning of the LED, for example indoor or outdoor installation. However, the materials defining the base 12 and stem 14 are not required to be the same materials. At the end of the neck 14 opposite the base 12 is a head 42. The head or casing 42 is a decorative attachment on the neck 14 and also serves as an upper housing for a lighting assembly 20. The lighting assembly 20 also includes a reflector 50, a diffuser 24, an optional guard 26 extending about the diffuser 24 as well as internal components described further herein.

Figure 2:
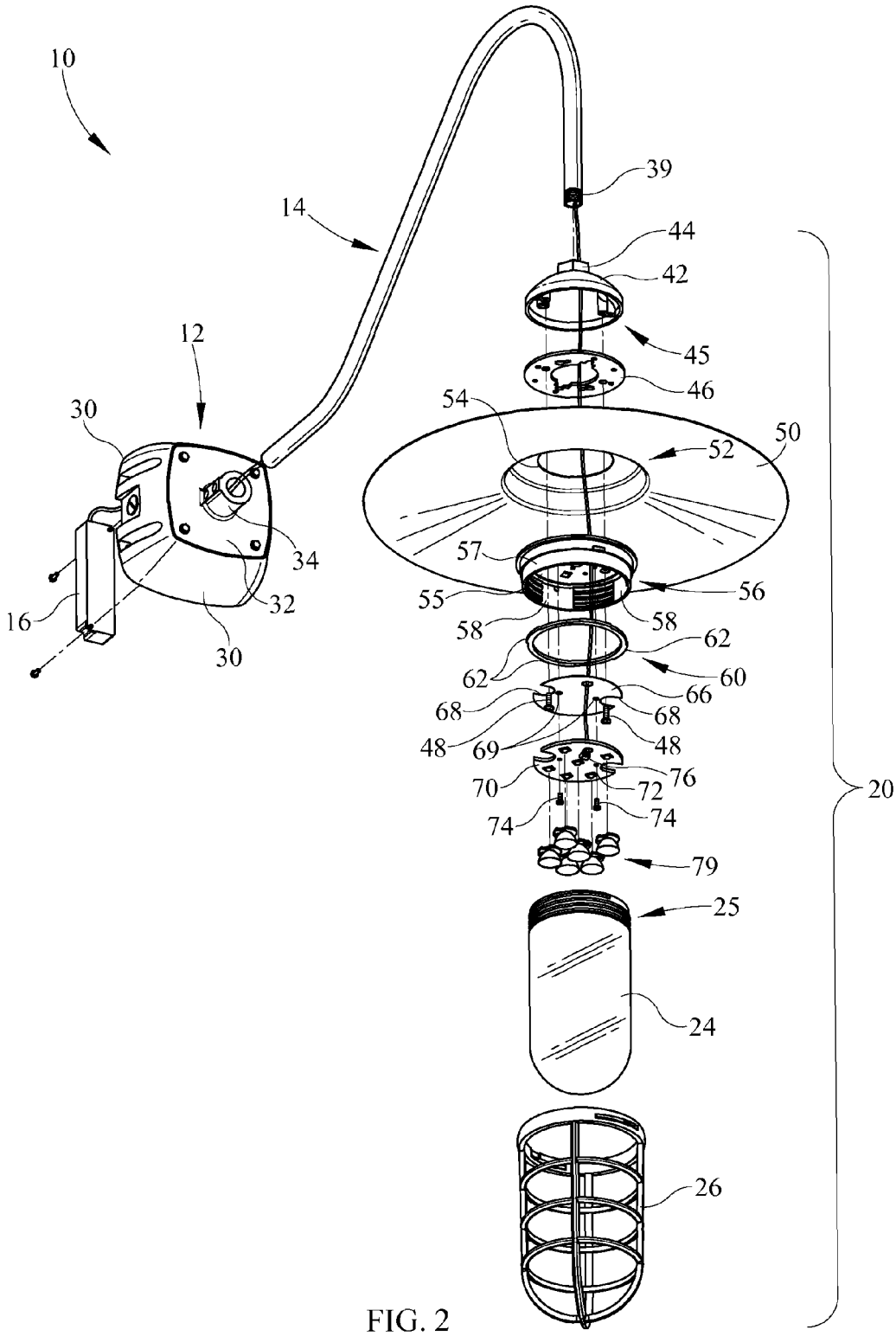
FIG. 2 is an exploded perspective view of the LED luminaire of FIG. 1.

Referring now to FIG. 2, the LED luminaire 10 is depicted in exploded perspective view. The base 12 is generally frusto-pyramidal in shape. The base 12 has four sidewalls 30 and a flat wall 32 joining the four sidewalls along a common edge, from which a collar 34 extends. The sidewalls 30 and top wall 32 define an enclosure where an LED driver 16 is positioned prior to attaching the base 12 to a structure such as a wall or ceiling structure. The LED driver 16 may be, for example, an Advance LED120A0700C24F0 17 W, 700 mA output, 120 VAC, 180 mA input. The collar 34 is cylindrical in shape and hollow for receiving one end of the neck 14. The neck 14 may be threaded to match an internal thread in the collar 34. In addition, or alternatively, the collar 34 may also comprise threaded apertures for the screws to aide in locking the neck 14 to the base 12.

As previously described, the neck 14 is tubular in shape, and according to the exemplary embodiment, is curved due to the mounting position of the base 12 on a vertical wall. However, such structure should not be considered limiting as the neck may be straight or have other shapes, if for example the base 12 is positioned on the ceiling. At the second end of the neck is an external thread 39. The threaded neck 14 receives a lighting assembly 20. More specifically, the threaded neck area 39 is received by casing 42. The exemplary casing 42 comprises one-half (½") inch national pipe thread (NPT) fitting 44 to allow various mounting options. However, this is exemplary and should not be considered limiting. At an upper end of the lighting assembly 20 is a casing 42 which threadably receives the thread 39 of the neck 14. As an alternative, the neck 14 could be formed to receive the casing 42. In any event, the casing 42 is substantially hemispherical in shape with an open hollow interior and end casings or other structures for receiving fasteners. At the upper end of the casing 42 is a threaded area 43 which receives the thread 39 during installation of the LED luminaire. Beneath the casing 42 is an upper connection plate 46 which is fastened to the lower open side of the casing 42. The upper connection plate 46 comprises a plurality of fastener apertures at least one of which aligns with casting 45 on the inside of the casing 42. These castings 45 receive screws 48 (FIG. 4) retaining portions of the lighting assembly 20 together.

Beneath the upper connection plate 46 is a reflector 50. The reflector 50 is an optional element depending on the lighting requirements of the area being illuminated. The reflector 50 may take various shapes and forms and may be formed of spun aluminum or other reflective materials. Alternatively, other materials may be utilized and either polished to have or coated with diffuse or specular finishes to reflect light in a desirable manner. The exemplary reflector 50 is substantially disc-like and has an angled shape from the central area down to the outer periphery. Again, this reflector 50 is merely exemplary in shape and should not be considered limiting as various alternative reflector designs may be utilized. In the central area of the reflector 50, is a recess 52. At the upper end of the recess 52 is a circular opening 54. The recess 52 and material surrounding the aperture 54 provide a seat for a heat sink 56.

The heat sink 56 is annular in shape having a top wall 55 and an annular sidewall 57. The annular sidewall 57 includes a plurality of helical threads 59 for connecting to a diffuser or globe 80. The threads 59 may be broken or discontinuous and are defined by spaced sections 58. The heat sink 56 may be formed of die cast aluminum and allows the LED engine 70 to efficiently transfer heat to the open air. Other efficient heat transferring materials may be utilized.

Beneath the heat sink 56 is a gasket 60. The gasket 60 is seated against the top wall 55 of the heat sink 56 when constructed. The inner surface of the upper inner surface of the top wall 55, which may also include a small lip at a preselected radial distance so as to define a seat for an LED array 70 and plate 66. The gasket 60 also includes a plurality of projections 62 which are aligned with the spaces 58 so that the gasket 60 may be moved against top wall 55 of the heat sink 56. Alternatively, the gasket 60 may be positioned against the previously described lip. The gasket 60 may be formed of various materials including rubber, polyurethane, rope gasket or other known sealant type materials which may also be an electrically insulating material.

Beneath the gasket 60 may be a lower connection plate 66. The plate 66 may be defined by an electrically insulative material. Additionally the material defining the plate 66 has good thermal transfer properties. The plate 66 acts as a gap filler between the heat sink 56 and the light engine 70 to improve thermal transfer from the light engine 70 to the heat sink 56. The lower connection plate 66 has at least one fastening area 68 for connection of the lower connection plate 66 to the heat sink 56, the upper connection plate 46 and the casing 42. The lower connection plate 66 also has fastening apertures 69 which allows for connection of an LED array 70 to the lower connection plate 66 and the heat sink 56 via fasteners 74. According to an alternative embodiment, a pressure sensitive adhesive may be utilized, alone or in addition to the fasteners 74 to affix the light engine 70 to the plate 66.

The LED array or light engine 70 comprises a plurality of light emitting diodes. The LED light engine 70 is formed of a printed metal circuit board and includes a plurality of light emitting diodes (LEDs) electrically connected thereto. The LED array 70 comprises at least one fastening aperture 72 and at least one fastener 74 extending through the LED array into the connection plate 66 and heat sink 56. The LED array 70 further comprises a power supply connector 76 electrically connected to a wire extending from the LED driver 16 in the base 12 through the neck 14 and to the LED array 70 for providing a power supply to the LED array and LEDs 78 thereon. The LEDs 78 are defined by a plurality of cool white light emitting diodes and at least one red light emitting diode. By cool light LED, it is meant that the white light LED has an output correlated color temperature (CCT) of between about 4,000 to 10,000 degrees Kelvin (K). Various numbers of cool light LEDs may be utilized and at least one red LED is utilized to warm the cool white light. Additionally, depending on the number of cool light LEDs, a plurality of red LEDs may be utilized such that there are a higher number of white LEDs than red LEDs. The combination of the plurality of white LEDs and at least one red LED provides a warm light which may be characterized by a CCT of between about 2,500 to about 3,900 Kelvin (K).

Beneath the LED array 70, and corresponding to each LED, are a plurality of LED reflectors 79. These are optional and may be placed over the LEDs 78 to control the light and to further diffuse the light.

Beneath the LED reflector 78 is a diffuser or globe 24. The globe or diffuser 24 may be formed of tempered glass with a diffuse finish, or alternatively with a colored finish. The diffuse finish which mixes the red light of the red LED and the white light of the cool light LEDs. The diffuse finish also inhibits direct visual recognition of the at least one red LED. At the upper end of the diffuser 80 is a threaded portion 25. The thread 25 engages the helical thread 59 on the internal wall of the heat sink 56, so that diffuser 80 is retained in the lighting assembly 40. This configuration also hides the threaded connection from view from beneath the luminaire 10.

Beneath the diffuser 80 is an optional guard 26. This guard may be utilized to protect the diffuser but is optional, and may only be desired if the LED luminaire 10 is positioned outside or in an area of high industrial traffic or other such area where the diffuser 24 may be prone to breakage. The optional guard 26 may be formed of die cast aluminum or other materials depending on the environment in which the luminaire 10 will be utilized.

Figure 3:
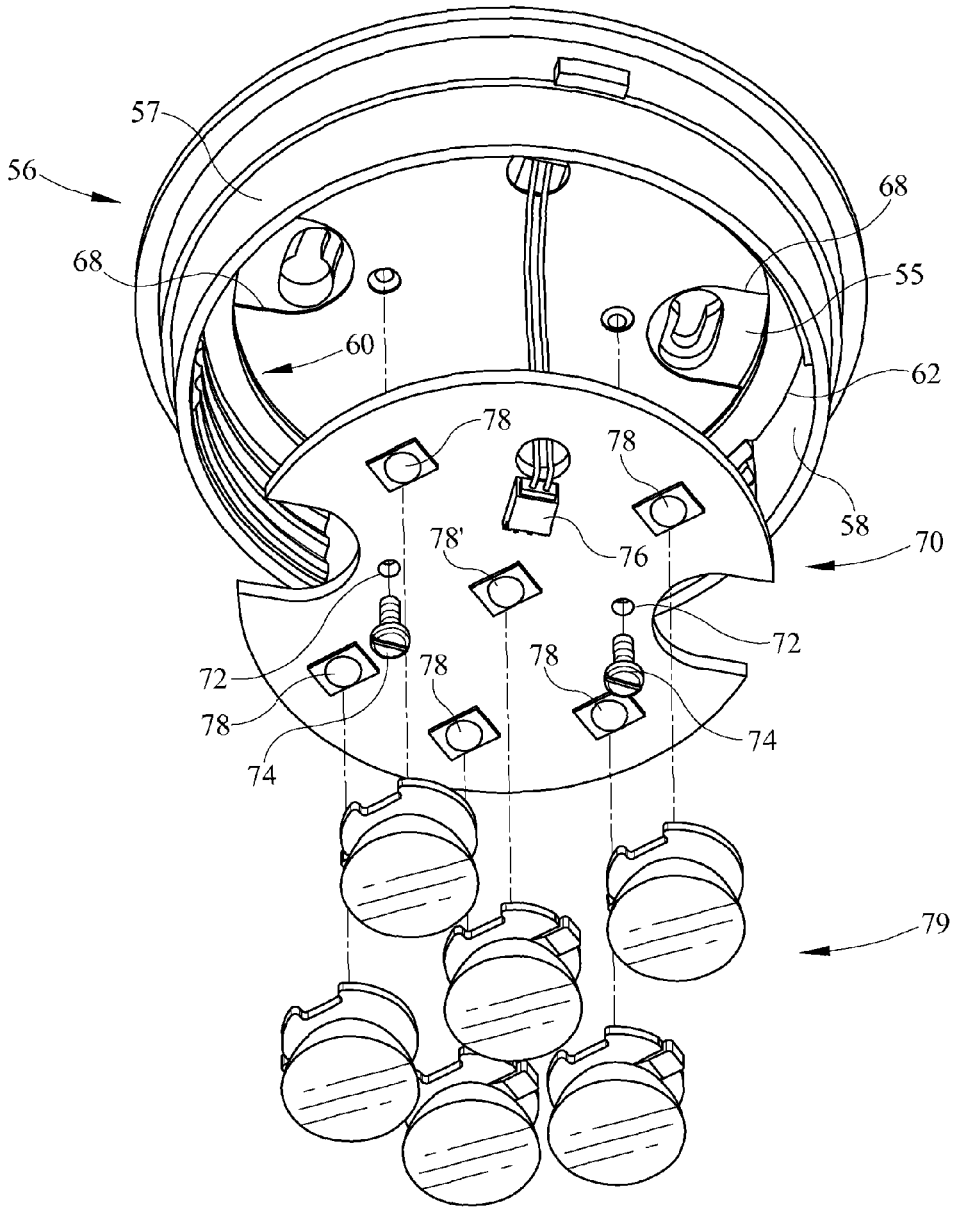
FIG. 3 is an exploded perspective view of a portion of the lighting assembly of FIG. 1 including LED reflectors.

Referring now to FIG. 3, portions of the lighting assembly 40 are depicted in a lower exploded perspective view. The heat sink 56 is substantially cylindrical in shape having an annular sidewall 57 and a plurality of internal threads 59 (FIG. 6) along the inner surface of sidewall 57 and spaced apart by gaps or spaces 58. The gaps 58 allow for positioning of gasket 60 and more specifically the gasket projections 62 extending from the peripheral edge of the gasket 60.

Exploded from the heat sink 56 is an LED array or light engine 70. The LED array 70 comprises a metal core printed circuit board (MCPCB) to optimize thermal transfer with the die cast aluminum housing or heat sink 56. The array 70 of the exemplary embodiment includes first and second fastening apertures 72 through which fasteners 74 pass and move through the lower connecting plate 66 disposed against the top wall 55 of the heat sink 56 and through the heat sink 56. On the array 70 are a plurality of cool white light LEDs. The cool white light LEDs have a nominal CCT of 4,000 degrees Kelvin (K). The array 70 also comprises at least one red LED 78', which according to the exemplary embodiment is the essential LED. A power supply connector 76 is also located on the array 70 and receives a connector from a power wire extending from the LED driver 16 through the neck 14 and to the array 70.

Beneath the array 70 are a plurality of optional reflectors 79. These reflectors control the light emitted from the LEDs 78,78' so as to better control or diffuse the light emitted therefrom. Moreover, there is one reflector 79 corresponding to each LED 78,78'.

As previously indicated, the light engine 70 utilizes a plurality of cool white light LEDs in combination with at least one red LED to warm the red LEDs while overcoming the efficiency problems known to other forms of providing warm light. The present light engine may utilize a plurality of cool white LEDs and one or more red LEDs depending on the number of white LEDs utilized. The light array therefore decreases the amount of electricity used for lighting by as much as 50% and may decrease the global consumption of electricity by some amount, estimated as much as 10%. Additionally, this will significantly reduce global carbon emissions and reduce the amount of mercury and other hazardous material in landfills which may come from other forms of lamps, such as high intensity discharge (HID) lamps.

The LEDs also have other advantages over the HID and fluorescent lights. LED lights are not affected by the frequent on and off cycling which causes fluorescent lamps to fail more quickly. The LEDs are instant on lamps unlike HID lamps which may take several minutes to warm or restart. LEDs are also not easily damaged like glass bulb lamps and do not fail by burning out, but simply dim over a long period of time. Therefore, the total cost of ownership is lower for LEDs because of their energy savings and long life. The totals cost of ownership may be considered as the installation costs, energy costs and maintenance costs.

The present LEDs may consume, for example, about 16 watts of energy. By comparison, a 42 watt CFL consumes 48 watts and a 100 watt metal halide may consume 129 watts. Similarly yet, a 150 watt incandescent lamp consumes 150 watts of energy. This indicates the decreased energy consumption.

The LED light engine also has a longer lamp life in comparison with the 42 watt CFL, the 100 watt metal halide and the 150 watt incandescent lamp. Further, the LEDs 78,78' have a cooler operating temperature than the fluorescent, HID and incandescent lamps.

Figure 4:
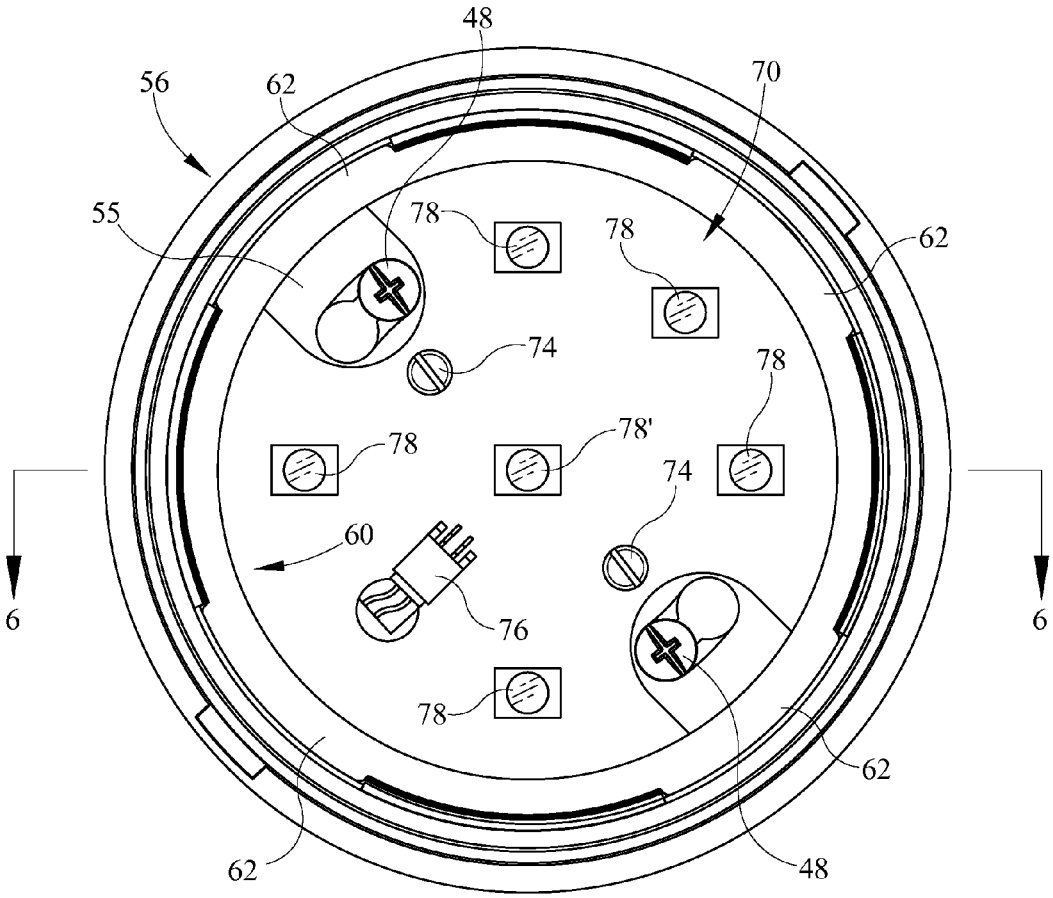
FIG. 4 is a bottom view of the portion of the lighting assembly of FIG. 1 without the reflectors.
Figure 5:
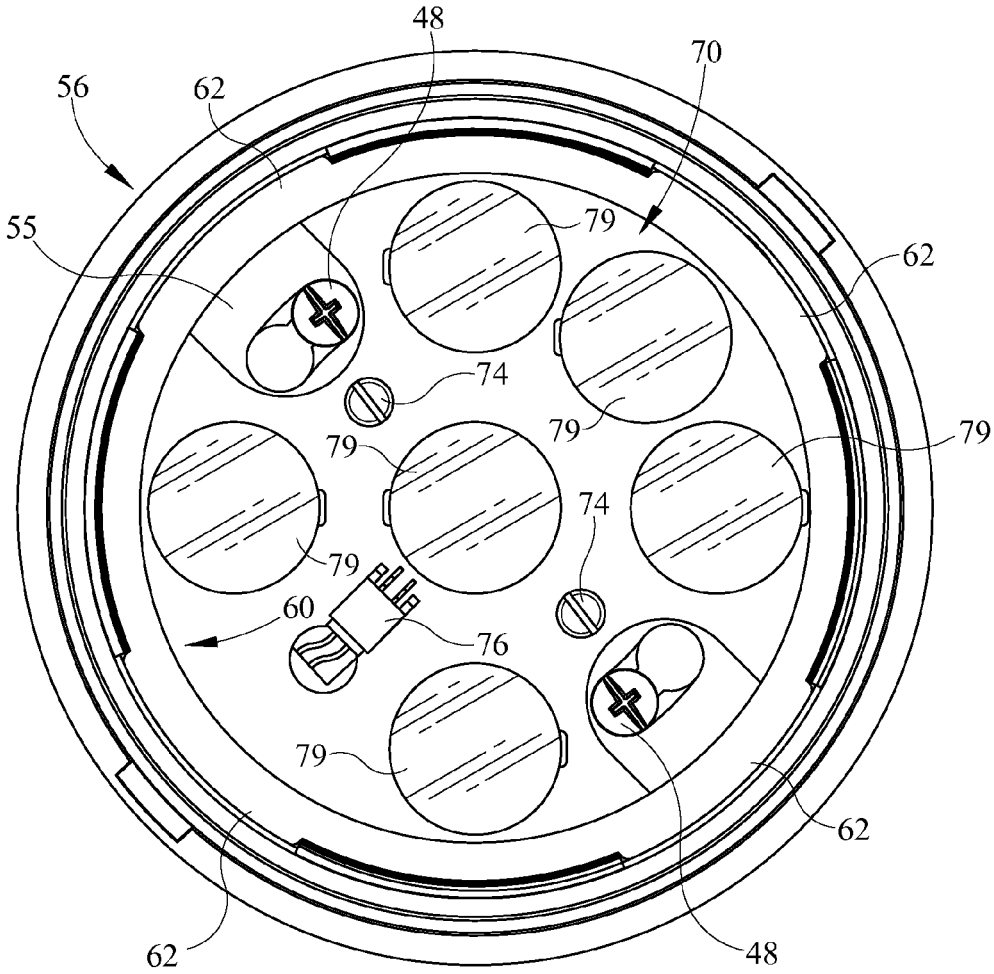
FIG. 5 is a bottom view of the lighting assembly of FIG. 4 with LED reflectors.

Referring now to FIG. 4, a bottom view of the lighting assembly 40 is depicted. Within the heat sink 56 the gasket 60 and projection 62 are visible. The light array or light engine 70 is positioned radially inwardly of the gaskets 60. Also extending through an aperture in the array 70, the power supply connector 76 is depicted for providing power to the array. Also shown in FIG. 4 are the fasteners 48 which extend from beneath the heat sink 56 through the top wall 55 and into the castings 45 of the casing or head 42.

In the embodiment shown in FIG. 4, the LEDs are shown without the reflectors 79 shown in FIG. 2. Alternatively, referring to FIG. 5, the reflectors 79 are depicted positioned all over the LEDs 78,78' in order to further control and diffuse the light emitted from the white LEDs 78 and the at least one red LED 78'. The combination of light controlling lenses 79 and the diffuse globe 24 creates a great deal of useable light with little to no glare.

Figure 6:
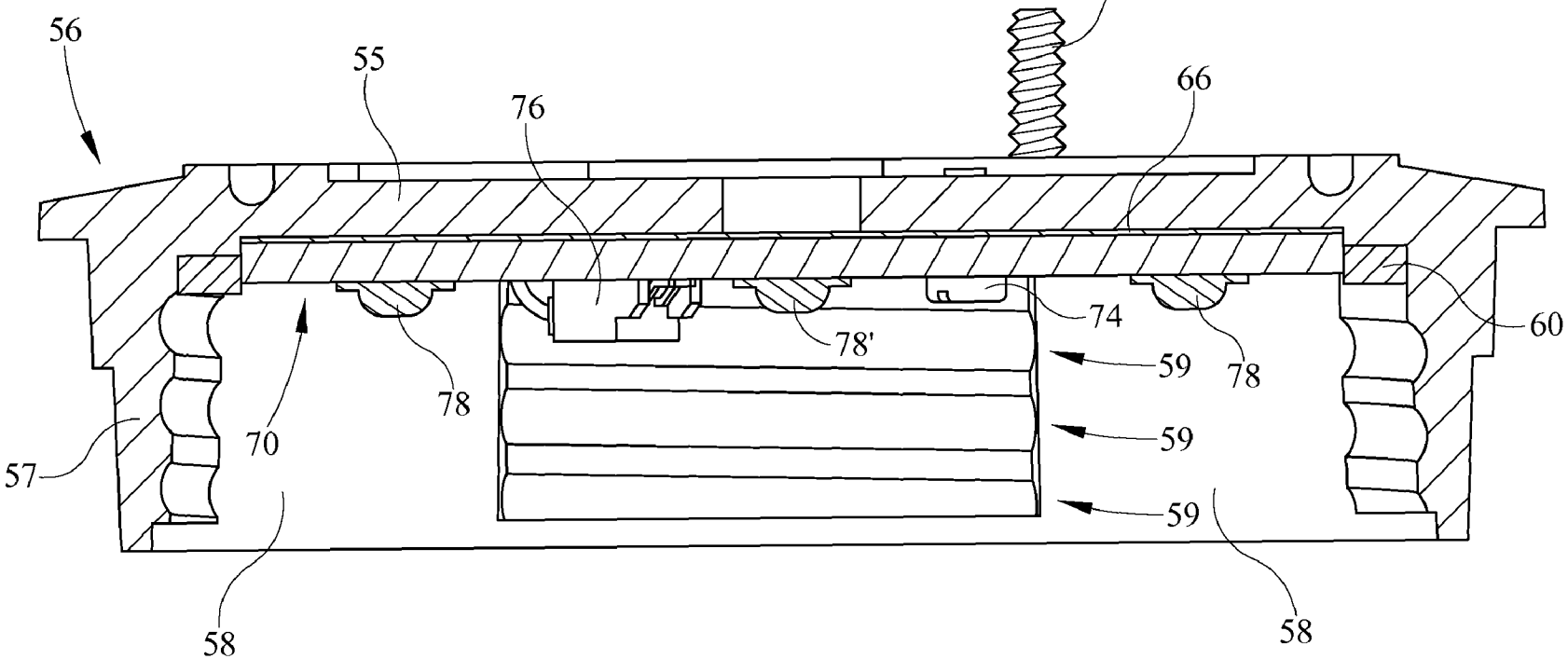
FIG. 6 is a section view of a portion of the lighting assembly.

Referring now to FIG. 6, a sectional view of a portion of the lighting assembly 40 is depicted. The heat sink 56 is shown with the top wall 55 and the sidewall 57 on an inner surface of the sidewall. The helical thread segments 59 are depicted for receiving of the color mixing diffuser 80 (FIG. 2). On the upper inner surface of the top wall 55 is the gasket element 60. Radially inward from the gasket, and disposed adjacent the top wall 55, is the lower connection plate 66. Opposite the connection plate 66 is the lighting array 70 or light engine. The light engine comprises a plurality of cool light LEDs 78 and at least one red LED 78'. Further, the light engine comprises a power supply connector 76 through which the printed circuit board is powered to drive the LEDs.

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An LED luminaire, comprising:
- a luminaire housing;
- a heat sink positioned adjacent said reflector;
- an LED array positioned adjacent and in thermal communication with said heat sink, said LED array having a plurality of cool white LEDs and at least one red LED to provide a warmer correlated color temperature at cooler operating temperature;
- a single reflector, positioned to reflect light from each of said LEDs in said array, and being one of integral with or depending from said housing;
- a diffuser for mixing the cool white LED light and the at least one red LED light, said diffuser inhibiting independent viewing of said at least one red LED.

2. The LED luminaire of claim 1, said diffuser having a jelly jar shape.

3. The LED luminaire of claim 2, said diffuser being formed of tempered glass.

4. The LED luminaire of claim 1, said diffuser being a holographic diffuser.

5. The LED luminaire of claim 1, wherein said LED array comprises fewer red LEDs than white LEDs.

6. The LED luminaire of claim 1, wherein said luminaire further comprises at least one additional reflector for each of said LEDs of said LED array.

7. The LED luminaire of claim 1, said cool white LEDs having a correlated color temperature of from about 4,000 to about 10,000 Kelvin.

8. The LED luminaire of claim 1, said warmer correlated color temperature being from about 2,500 to about 3,900 Kelvin (K).

9. An LED luminaire, comprising:
- a heat sink disposed above an LED array and in thermal communication with said LED array;
- said LED array having at least one red LED and a plurality of cool white LEDs, said at least one red LED providing a warmer correlated color temperature for an output light and said plurality of white LEDs providing a higher efficacy;
- a diffuser positioned to enclose said LED array between said heat sink and said diffuser;
- said diffuser color mixing said at least one red LED and said plurality of cool white LEDs rendering a red light from said at least one red LED indiscernible from a cool white light of said plurality of white LEDs;
- a single reflector, positioned to reflect light from each of said LEDs in said array, and positioned adjacent said heat sink.

10. The LED luminaire of claim 9, said diffuser being formed of tempered glass and having a diffuse coating on one of an inner surface, an outer surface or both surfaces of said diffuser.

11. The LED luminaire of claim 9, said warmer output light having a correlated color temperature of between about 2,500 to about 3,900 Kelvin (K).

12. An LED luminaire, comprising:
- an upper housing;
- an LED array positioned within said upper housing;
- a heat sink in thermal communication with said LED array;
- said LED array having at least one red LED and a plurality of cool white LEDs;
- a single reflector, positioned to reflect light from each of said LEDs in said array;
- a diffuser disposed at least in part beneath said reflector;
- said diffuser mixing the light emitted from said LEDs rendering red light emitted from said at least one red LED discernable from white light emitted from said plurality of cool white lights.

13. The LED luminaire of claim 12 further comprising a connecting plate disposed between said heat sink and said LED array.

14. The LED luminaire of claim 13, said connecting plate having high heat transfer characteristics.

15. The LED luminaire of claim 12 wherein said reflector is disposed adjacent said heat sink.

16. An LED luminaire comprising:
- a circuit board;
- a plurality of cool white light emitting diodes and at least one red light emitting diode, each of said cool white light emitting diodes and said at least one red light emitting diode coupled to said circuit board;
- a translucent diffuser disposed about said circuit board thereby encompassing each of said light emitting diodes;
- a reflector surrounding said translucent diffuser;
- wherein the circuit board comprises a greater number of cool white LEDs than red LEDs; and, wherein a light output is warmer than a cool white light and has a correlated color temperature of between about 2,500 to about 3,900 Kelvin (K).

17. The LED luminaire of claim 16 wherein said circuit board comprises five of said cool white LEDs and one of said red light emitting diodes.

18. The LED luminaire of claim 16 wherein said translucent diffuser is longitudinally extending and has a first end proximate said light emitting diodes and a second dome shaped end opposite said first.

* * * * *